US011598619B2

(12) United States Patent
Carlsson et al.

(10) Patent No.: US 11,598,619 B2
(45) Date of Patent: Mar. 7, 2023

(54) DELAY UNIT FOR A PROJECTILE

(71) Applicant: SAAB AB, Linköping (SE)

(72) Inventors: Michael Carlsson, Karlskoga (SE); Mats Runemård, Kristinehamn (SE); Erik Fohrman, Falkoeping (SE); Owe Englund, Karlskoga (SE)

(73) Assignee: SAAB AB, Linkoeping (SE)

( * ) Notice: Subject to any disclaimer, the term of this patent is extended or adjusted under 35 U.S.C. 154(b) by 19 days.

(21) Appl. No.: 17/312,586

(22) PCT Filed: Dec. 12, 2019

(86) PCT No.: PCT/SE2019/051272
§ 371 (c)(1),
(2) Date: Jun. 10, 2021

(87) PCT Pub. No.: WO2020/122803
PCT Pub. Date: Jun. 18, 2020

(65) Prior Publication Data

US 2021/0356244 A1 Nov. 18, 2021

(30) Foreign Application Priority Data

Dec. 14, 2018 (SE) ..... 1800241-0

(51) Int. Cl.
*F42C 15/30* (2006.01)

(52) U.S. Cl.
CPC ..... *F42C 15/30* (2013.01)

(58) Field of Classification Search
CPC ..... F42C 15/00; F42C 15/28; F42C 15/30; F42C 9/06
See application file for complete search history.

(56) References Cited

U.S. PATENT DOCUMENTS 682,728 A 9/1901 Lynch et al.
2,674,946 A 4/1954 Hjelm
(Continued)

FOREIGN PATENT DOCUMENTS

GB 2159931 B 2/1988
WO WO 91/07635 A1 5/1991
(Continued)

OTHER PUBLICATIONS

EP Patent Application No. 19895653.4, Extended European Search Report dated Jul. 20, 2022, 6 pages.
(Continued)

*Primary Examiner* — Benjamin P Lee
(74) *Attorney, Agent, or Firm* — Alston & Bird LLP

(57) ABSTRACT

The invention relates to a method of delaying a mechanism in a firearm and a delay unit for a projectile comprising i) a first and a second pressure chamber (3*a*, 3*b*) arranged to receive combustion gases in a firearm via at least one inlet (1*a*, 1*b*) arranged to each of said first and second pressure chambers (3*a*, 3*b*) following firing of a projectile ii) at least one outlet for transferring the combustion gases (4*a*, 4*b*), arranged to each of said first and second pressure chambers (3*a*, 3*b*), to a piston chamber in which a displaceable piston (6) is arranged dividing the piston chamber into a compartment (5*b*) having a volume $V_1$ upstream the piston (6) and a compartment (5*a*) having a volume $V_2$ downstream the piston (6), wherein said at least one outlet (4*a*, 4*b*) from the first and second pressure chambers (3*a*, 3*b*) are arranged to transfer said combustion gases to said compartments (5*a*, *b*) of said piston chamber to provide an overall pressure difference between compartments (5*a*) and (5*b*) pressing the piston (6) at an initial idle position downstream whereby the volume $V_2$ of compartment (5*a*) is reduced and whereby the piston (6) being pressed downstream towards an end posi-
(Continued)

tion actuates a function at a predetermined point in time following firing of a firearm.

16 Claims, 4 Drawing Sheets

(56) References Cited

U.S. PATENT DOCUMENTS

| | | | | |
|---|---|---|---|---|
| 2,918,870 A | | 12/1959 | Meister | |
| 2,926,609 A | | 3/1960 | Goey et al. | |
| 3,229,638 A | | 1/1966 | Woolston et al. | |
| 5,243,917 A | * | 9/1993 | Komstadius | F42C 15/30 102/357 |
| 5,329,854 A | * | 7/1994 | Komstadius | F42C 15/30 102/505 |

FOREIGN PATENT DOCUMENTS

| | | | | |
|---|---|---|---|---|
| WO | WO 91/07636 A1 | | 5/1991 | |
| WO | WO-2020122803 A1 | * | 6/2020 | F42C 15/30 |

OTHER PUBLICATIONS

EP Patent Application No. 19895653.4, Extended European Search Report dated Jul. 7, 2022, 6 pages.

International Searching Authority, International Search Report and Written Opinion received for International Application No. PCT/SE2019/051272, dated Feb. 7, 2020, 13 pages, Swedish Patent and Registration Office, Sweden.

Swedish Patent and Registration Office, Search Report and Technical Report received for Application No. SE1800241-0, dated Jun. 20, 2019, 7 pages, Sweden.

* cited by examiner

DELAY UNIT FOR A PROJECTILE

CROSS REFERENCE TO RELATED APPLICATIONS

This application is a National Stage Application, filed under 35 U.S.C. § 371, of International Application No. PCT/SE2019/051272, filed Dec. 12, 2019, which claims priority to Sweden Application No. 1800241-0, filed Dec. 14, 2018; the contents of both of which as are hereby incorporated by reference in their entireties.

BACKGROUND

Related Field

The present invention relates to a delay unit and the use thereof. The invention also relates to a method of delaying a mechanism in a firearm.

Description of Related Art

SAI (Safety/Arming/Ignition) units are well known in weapon technology to prevent premature detonation of charges. However, premature detonation may still be an issue due to inter alia formation of shock waves subsequent to firing or deployment of fins of e.g. shells. Shock waves formed will propagate to piezoelectric sensors or other devices which may initiate detonation when triggered. When a sufficiently strong shock wave reaches a piezoelectric crystal, a sufficiently high voltage level is formed resulting in the formation of an ignition pulse. An electric blasting cap may then be turned to an armed position in-line with the ignition chain thus causing considerable risks for detonation. There is thus a need to further increase safety in addition to commercially available SAI units such that undesired arming and detonation of shells does not occur.

The present invention intends to provide a safety means preventing undesired premature arming occurs. In particular, an object of the present invention is to provide safety means delaying any undesired premature mechanisms occurring subsequent to firing. In particular, an object of the invention is to delay premature mechanisms from occurring due to formation of shock waves following e.g. firing or deployment of fins in a projectile. A further object of the invention is to provide a delay mechanism requiring no supplemental energy than the kinetic energy of flowing combustion gases following firing. A further object of the invention is to provide a compact delay unit occupying minimal volume. A further object of the invention is to provide a compact delay unit enabling precise and controlled delay of a mechanism such as the detonation of a shell, especially short delays in the range of e.g. microseconds (ms). A further object of the invention is to provide a delay unit enabling storage of energy for a controlled period of time which energy is subsequently used to actuate a mechanism such as the actuation of a piston.

BRIEF SUMMARY

The present invention relates to a delay unit for a projectile comprising i) a first and a second pressure chamber arranged to receive combustion gases in a firearm via at least one inlet arranged to each of said first and second chambers following firing of a projectile ii) at least one outlet for transferring the combustion gases, arranged to each of said first and second pressure chambers, to a piston chamber in which a displaceable piston is arranged dividing the piston chamber into a compartment 5*b* having a volume $V_1$ upstream the piston and a compartment 5*a* having a volume $V_2$ downstream the piston, wherein said at least one outlet from the first and second pressure chambers are arranged to transfer said combustion gases to said compartments 5*a*, 5*b* of said piston chamber to provide an overall pressure difference between compartments 5*a* and 5*b* pressing the piston at an initial idle position downstream whereby the volume $V_2$ of compartment 5*a* is reduced and whereby the piston being pressed downstream towards an end position actuates a function at a predetermined point in time following firing of the firearm.

According to one embodiment, the delay unit is arranged in a firearm at the rear end of a projectile to be fired.

According to one embodiment, combustion gases from the respective pressure chambers are transferred only to compartment 5*b*. According to one embodiment, the combustion gases from the first pressure chamber are only transferred to compartment 5*b* and the combustion gases from the second pressure chamber are only transferred to compartment 5*a*. In principle, each outlet from the respective pressure chambers could be so arranged to transfer combustion gases to both compartments 5*a* and 5*b*. In any event, the delay unit must be designed such that a pressure drop is established over the piston forcing it downstream. This may be obtained in various manners, for example by dimensioning of the pressure chamber volumes. An overall pressure difference between compartments 5*a* and 5*b* will expose the piston of the piston chamber to a pressure forcing it downstream from an initial idle position to an end position. Depending on the pressure difference established, the piston will be actuated at different rates. A higher pressure difference will result in a faster movement thereof. This may be dimensioned according to the use of the delay unit.

By the term "Volume $V_1$" is meant the volume upstream the piston corresponding to the volume of compartment 5*b*. This volume is variable depending on the position of the piston. Before actuation of the piston, the piston is at an initial idle position from which it is displaced when actuated. As the piston is displaced downstream, the volume $V_1$ will increase. The term "Volume $V_2$" corresponds to the compartment 5*a* downstream the piston. The volume $V_2$ will decrease as the piston is displaced downstream from an initial idle position. According to one embodiment, volume $V_1$ when the piston is in an idle position ranges from 1 to 10 $mm^3$, for example from 5 to 10 $mm^3$. According to one embodiment, volume $V_2$ when the piston is in an idle position ranges from 50 to 100 $mm^3$, for example from 70 to 100 $mm^3$ or from 80 to 100 $mm^3$. According to one embodiment, the total volume, i.e. the volume of both $V_1$ and $V_2$ ranges from 50 to 110 $mm^3$, most preferably from 80 to 110 $mm^3$.

As an overall pressure difference is established pressing the piston downstream, a pressure difference thus actuates the piston whereby it is displaced. In order to actuate the piston from an initial idle position downstream, the pressure upstream the piston must be greater than the pressure downstream the piston so that it is forced downstream.

According to one embodiment, said at least one inlet to each of said first and second pressure chambers is an inlet channel.

According to one embodiment, the projectile is a missile or a shell, preferably a shell.

According to one embodiment, a resilient means, preferably a spring, is arranged to maintain the piston immovable at an initial idle position prior to establishing a pressure difference between said compartments. The resilient means may be used as a further safety means to prevent displacement of the piston before a pressure difference is established between the volumes $V_1$ and $V_2$ in the piston chamber. In case a resilient means is used, the force exerted by the resilient means must be taken into account when dimensioning the overall pressure drop over the piston since the resilient means will oppose displacement of the piston downstream to some extent.

According to one embodiment, the piston is arranged to block an opening, e.g. an outlet channel from the piston chamber to a subchamber. Preferably, the piston is initially arranged prior to actuation thereof in an initial idle position at which it is blocking an opening between the piston chamber and a subchamber. Preferably, the piston is arranged to, as combustion gases start to flow into the piston chamber, be displaced from its initial idle position at which initial position it is preventing flow of combustion gases from the piston chamber to a subchamber. Preferably, the piston is arranged to enable unblocking of the opening following displacement of the piston from its initial idle position whereby an opening to a subchamber gradually unblocks. Preferably, as the opening unblocks, combustion gases flow into the subchamber from the piston chamber, preferably from volume $V_1$ upstream of the piston. Preferably, as the piston has reached its end position, at which it can no longer be pressed downstream, the opening between the piston chamber and the subchamber is entirely unblocked.

According to one embodiment, the subchamber is provided with a displaceable subchamber piston arranged to be displaced from an initial idle position when exposed to flow of combustion gases originating from the piston chamber.

According to one embodiment, the subchamber has a volume ranging from 100 to 1000, preferably from 250 to 750, and most preferably from 400 to 600, such as from 525 to 575 $mm^3$. Depending on the position of the piston of the subchamber which before actuation thereof is in an idle position, the volume upstream and the volume downstream of the subchamber piston will vary. However, the total volume of the subchamber will be as indicated above according to the mentioned embodiment.

According to one embodiment, the piston in the piston chamber has an area facing the volume $V_2$, i.e. downstream the piston ranging from 1 to 50, preferably from 5 to 25, and most preferably from 10 to 15 such as 13 to 13.5 $mm^2$. According to one embodiment, the piston has an area facing the first volume $V_1$, i.e. upstream the piston ranging from 0.1 to 50, preferably from 1 to 25, more preferably from 3 to 10, such as from 3 to 5 $mm^2$.

According to one embodiment, the inlets of the first and second chambers suitably have the same area. Preferably, the area of each inlet thereof ranges from 0.1 to 50, preferably from 2 to 10, and most preferably from 4 to 5 $mm^2$.

According to one embodiment, at least one outlet is provided in the first and/or the second pressure chamber for evacuating a predetermined portion of said combustion gases outside of the delay unit. Preferably, at least one outlet for evacuation of combustion gases from at least one pressure chamber may be used to establish a pressure difference between the pressure chambers which in turn will be used to establish a pressure difference in the piston chamber.

According to one embodiment, the inlets to the pressure chambers, preferably inlet channels, are arranged to receive flow of combustion gases such that the gases can enter the inlets substantially without changing direction. Thus, preferably, the inlets are arranged to allow gases to enter the inlets without changing direction of the flow of the gases.

According to one embodiment, the outlets of the pressure chambers for transferring combustion gases to the piston chamber are arranged at the opposite side of the first and second pressure chambers relative to the inlets.

According to one embodiment, the delay unit is arranged to break a short circuit in which a piezoelectric sensor, preferably a piezoelectric crystal, is arranged.

According to one embodiment, each of the inlets of said first and second chambers are provided with a back valve preventing combustion gases from flowing out from said inlets of the chambers. The back valves thus reduce otherwise potential pressure losses in the chambers.

According to one embodiment, the back valves are arranged inside inlet channels to protect the valves from shock waves.

According to one embodiment, the volume ratio of said first to said second chamber ranges from 1:10 to 10:1, preferably from 1:2 to 2:1, and most preferably from 1:1.2 to 1.2:1.

According to one embodiment, the volume ratio of said first to said second chamber ranges from 1:1.1 to 1.1:1. Preferably, the volume of the first and second chambers is identical.

According to one embodiment, the volume of the first chamber ranges from to 100 to 5000, more preferably from 500 to 2000, and most preferably from 800 to 1100, such as from 900 to 1000 $mm^3$.

According to one embodiment, the volume of the second chamber ranges from 100 to 5000, preferably from 500 to 2000, and most preferably from 800 to 1300, such as from 1000 to 1100 $mm^3$.

According to one embodiment, the outlet or outlets for evacuating combustion gases has a length ranging from 1 to 50, preferably from 2 to 25, and most preferably from 5 to 7 mm.

According to one embodiment, the outlet or outlets for evacuating combustion gases has an area ranging from 0.01 to 10, more preferably from 0.1 to 1, and most preferably from 0.3 to 0.4 $mm^2$.

According to one embodiment, the outlets for transferring combustion gases from each of the chambers to the piston chamber have an area ranging from 0.5 to 50, more preferably from 1 to 5, and most preferably from 1 to 2 $mm^2$.

According to one embodiment, the area of the outlets of the pressure chambers is identical.

According to one embodiment, a fuze is connected to the delay unit. Preferably, the fuze is arranged in the front part of the projectile.

According to one embodiment, a piezoelectric sensor, e.g. a piezoelectric crystal is connected to the delay unit.

According to one embodiment, the subchamber piston is arranged to break a short circuit comprising a piezoelectric crystal following actuation of the subchamber piston. As the short circuit is broken, the piezoelectric crystal will be triggered by shock waves it senses.

According to one embodiment, the opening between the piston chamber and the subchamber has an area ranging from 1 to 10 $mm^2$, preferably from 1 to 5 $mm^2$, and most preferably from 1 to 2 $mm^2$.

According to one embodiment, the opening between the piston chamber and the subchamber has a length ranging from 1 to 10 mm, preferably from 1 to 5 mm, and most preferably from 1 to 2 mm.

According to one embodiment, the opening between the piston chamber and the subchamber has a volume ranging from 1 to 10 $mm^3$, preferably from 1 to 5 $mm^3$, and most preferably from 2 to 4 $mm^3$.

The invention also relates to a method of delaying a mechanism in a firearm comprising a delay unit as described herein. Preferably a delay of at least 15 ms is established. At such delay, preferably a pressure difference between said first and second chambers ranging from $0.1\times10^7$ to $10^8$, preferably from $0.5\times10^7$ to $5\times10^7$, and most preferably from $0.9\times10^7$ to $2\times10^7$ Pa is established. According to one embodiment, the delay period is at least 1, more preferably at least 100, and most preferably at least 5000 ms. As an example the delay period is from 1 to 5000 ms, for example 1 to 100 ms.

The invention also relates to a method of preventing premature detonation of a warhead comprising the use of a delay unit as described herein.

The invention also relates to the use of a delay unit for delaying premature detonation of a warhead.

The invention being thus described, it will be obvious that the same may be varied in many ways. Such variations are not to be regarded as a departure from the gist and scope of the present invention, and all such modifications as would be obvious to one skilled in the art are intended to be included within the scope of the claims.

WORKING EXAMPLES

Pressurized bomb tests were performed by means of three different delay unit embodiments. The dimensions of the delay unit were as provided in table 1 below:

TABLE 1

| | Area ($mm^2$) | Length (mm) | Volume ($mm^3$) |
|---|---|---|---|
| Piston area facing volume $V_2$ | 13.28 | | |
| Piston area facing volume $V_1$ | 3.84 | | |
| Areas of inlets to 3a, 3b | 4.15 | | |
| Outlet of 3b for evacuating combustion gases | corresponding to width of holes of table 2 (tests 1-3) | 6 | |
| Outlets from 3a, 3b for transferring combustion gases to piston chamber | 1.77 | | |
| Chamber 3a | | | 1071.23 |
| Chamber 3b | | | 960.54 |
| $V_2$ (when piston in initial idle position) | | | 81.921 |
| $V_1$ (when piston in initial idle position) | | | 6.922 |
| 4a (outlet to $V_1$) | 1.77 | 2.23 | 3.939 |
| 4b (outlet to $V_2$) | 1.77 | 2.20 | 2.207 |
| Initial volume downstream piston 10 | | | 418.893 |
| Initial volume upstream piston 10 | | | 120.495 |
| Opening 8 between piston chamber and subchamber | 1.77 | 2.23 | 3.94 |
| Area of piston in subchamber | 110.7 | | |

The tests for each unit were repeated once. The delay of the displacement of the subchamber piston (plunger) 10 following release of gas via outlet 4*b* (cf. FIG. 2, outlet 4*b* being positioned below outlet 4*a*) was measured. The delay unit was exposed to pressures (activation pressures) as indicated in table 2 below (Pressure in). The pressure released via outlet channel 8 to the subchamber is indicated in table 2 below as Pressure out. An evacuation hole was provided in chamber 3*b* only (FIG. 2) with diameters as indicated in table 2 in tests 1-3. As can be noted, differences in the delay of the movement of the subchamber piston 10 varies with the pressure to which the delay unit is exposed and the dimension of the evacuation hole. In all tests, the full movement of the subchamber piston 10 was in the range from 5.1 to 5.9 mm.

TABLE 2

| | Evacuation hole [mm] | Pressure in [MPa] | Pressure out [MPa] | Delay [ms] |
|---|---|---|---|---|
| Test 1 | 0.6 | 50 | 4 | 25 ms |
| Test 2 | 0.7 | 44 | 9 | 15 ms |
| Test 3 | 0.45 | 48 | 7 | 30 ms |

DETAILED DESCRIPTION OF VARIOUS EMBODIMENTS

Figure 1:
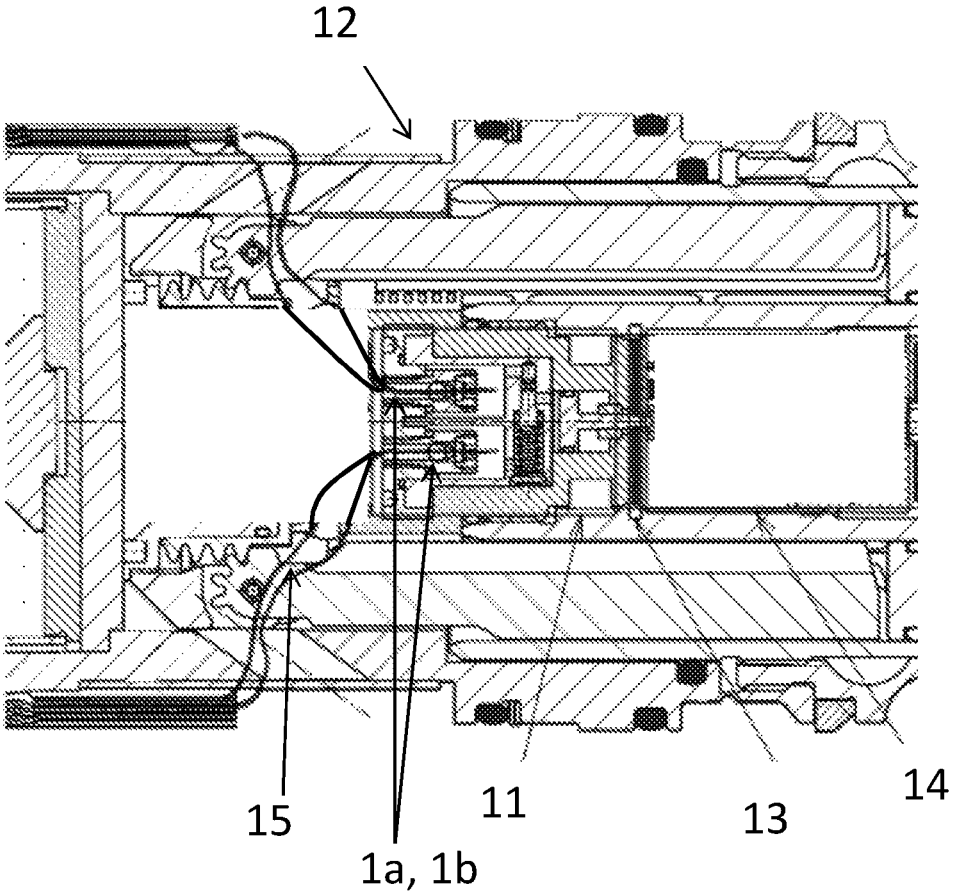
FIG. 1 discloses an overview comprising a delay unit positioned in a round (projectile) of a firearm and how combustion gases enter the delay unit.

FIG. 1 shows a delay unit 11 mounted in a round 12. The black strip 13 represents a short circuit which, subsequent to actuation and displacement of a subchamber piston 10, is broken after a predetermined period of time (the delay unit is dimensioned to result in a predetermined delay). By breaking the short circuit, arming for subsequent detonation of a warhead (not shown) may be initiated. An SAI (Safety/Arming/Initiation) unit 14 is arranged adjacent to the delay unit 11, i.e. behind the delay unit 11 in the firing direction. Illustrated lines 15 show the flow of combustion gases originating from combusted propellant (not shown on the left-hand side of the delay unit in FIG. 1). Combustion gases flow into the inlet channels 1*a*, 1*b* of the pressure chambers 3*a*, 3*b* of the delay unit 11 whereby a pressure is accumulated therein.

Figure 2:
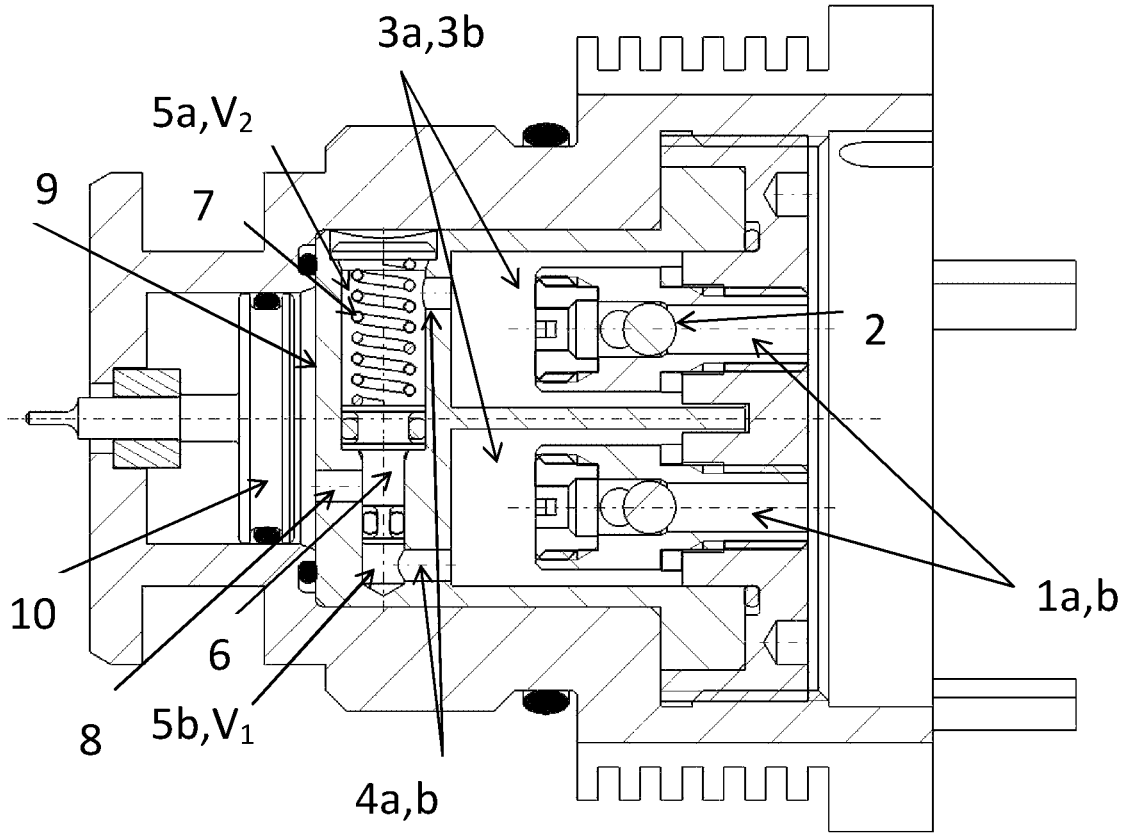
FIG. 2 discloses a delay unit comprising a piston chamber in which piston 6 is positioned in an initial idle position before firing.

FIG. 2 shows a delay unit comprising two pressure chambers (3*a*, 3*b*) having predetermined volumes.

According to one embodiment of the invention, which applies generally and not only in association with FIG. 2, the outlets from the pressure chambers (3*a*, 3*b*) may have a volume ranging from 0.1 to 50, preferably from 1 to 10, most preferably from 1 to 5 $mm^3$. According to one embodiment, the area of the outlets from the pressure chambers (3*a*, 3*b*) may range from 1 to 10, preferably from 1 to 5, most preferably from 1 to 2 $mm^2$. According to one embodiment, the length of the outlets from the pressure chambers (3*a*, 3*b*) may range from 1 to 10, preferably from 1 to 5, most preferably from 2 to 3 mm.

As a projectile is fired (not shown), combustion gases flow into inlet channels 1*a*, 1*b* whereby a pressure is accumulated in pressure chambers 3*a*, 3*b* whereby an overpressure is obtained in each of the pressure chambers 3*a*, 3*b*. As combustion gases enter the inlet channels 1*a*, 1*b*, back valves 2 in each of the channels 1*a*, 1*b* allow combustion gases to enter while safeguarding no combustion gases leak out via the inlet channels 1*a*, 1*b*.

The chambers 3*a*, 3*b* are provided with outlet channels 4*a, b* through which combustion gases are transferred to a piston chamber divided into two compartments 5*a* and 5*b* by a piston 6 arranged in the piston chamber. The piston 6 has a first area facing the compartment 5*a*. The piston 6 has a second area facing a compartment 5*b* (below compartment 5*a* in FIG. 2). The piston 6 thus separates the piston chamber into two compartments. The spring 7 safeguards the piston is maintained in an initial idle position. As can be noted in FIG. 2, an opening (outlet) is arranged between the piston chamber and a subchamber 9. By maintaining the piston 6 in its initial idle position before any gas enters compartment 5*b*, piston 6 ensures there is no gas leaking out of the piston chamber via outlet channel 8 to the subchamber 9 provided with a subchamber piston 10. As a pressure difference arises in the piston chamber following firing as combustion gases flow into the pressure chambers 3*a*, 3*b*, and transferred to the piston chamber, the piston 6 will be displaced from an initial idle position in FIG. 2 to an intermediate position as further shown in FIG. 3. The piston 6 is displaced downstream such that the spring 7 is compressed. The arising pressure difference forces the piston 6 downstream by providing a higher pressure in compartment 5*b* than in compartment 5*a*. Hence, the piston 6 will be brought into motion due to the pressure difference. A low pressure difference, for example a somewhat higher pressure in compartment 5*b* than 5*a* will result in a relatively slow motion of the piston 6 whereas a higher pressure difference imparts a quicker displacement of piston 6. It goes without saying the skilled person can design suitable areas of e.g. inlets 1*a*, 1*b* as well as outlets 4*a*, 4*b* to dimension the delay unit depending on the requirements and use thereof. For example, the dimensioning of an evacuation hole may be used to establish a pressure difference in the pressure chambers which in turn may be used to establish a pressure difference in the piston chamber.

Figure 3:
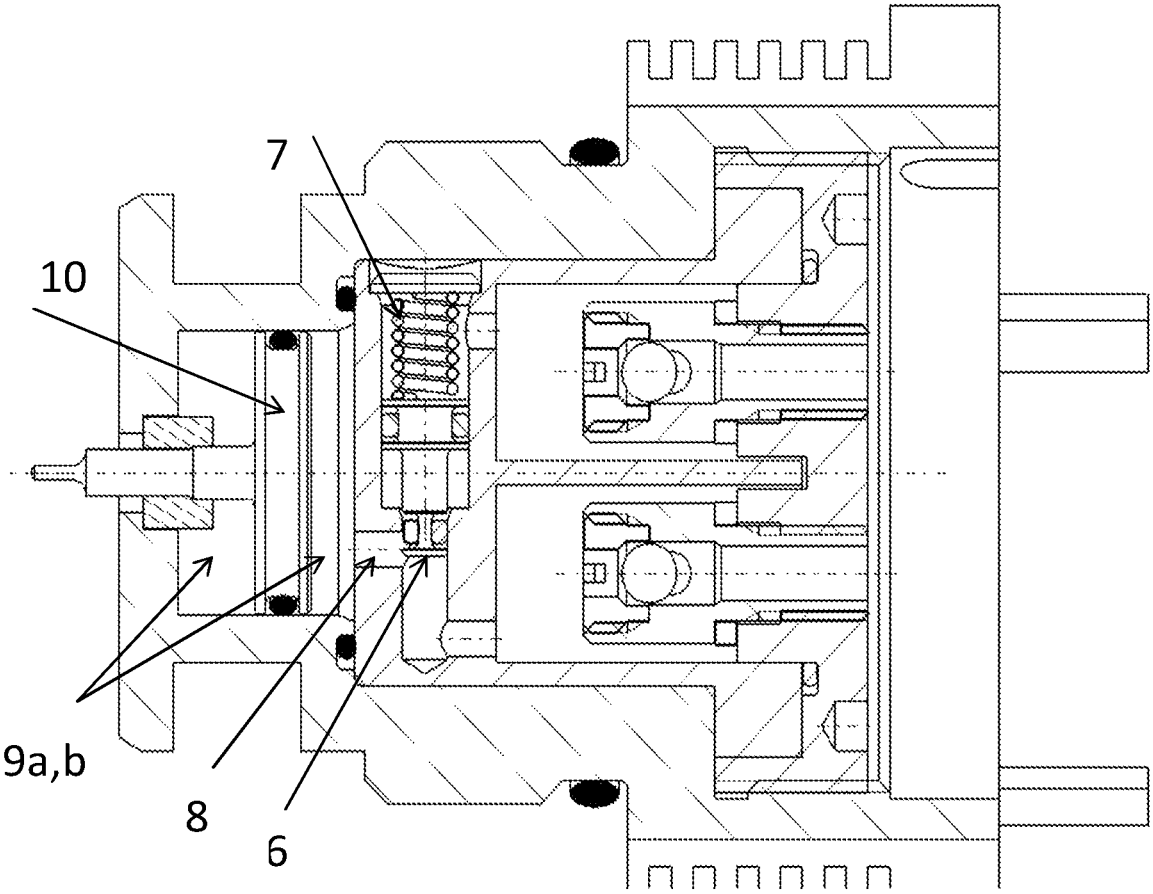
FIG. 3 discloses a delay unit in which piston 6 has been displaced from its initial position.
Figure 4:
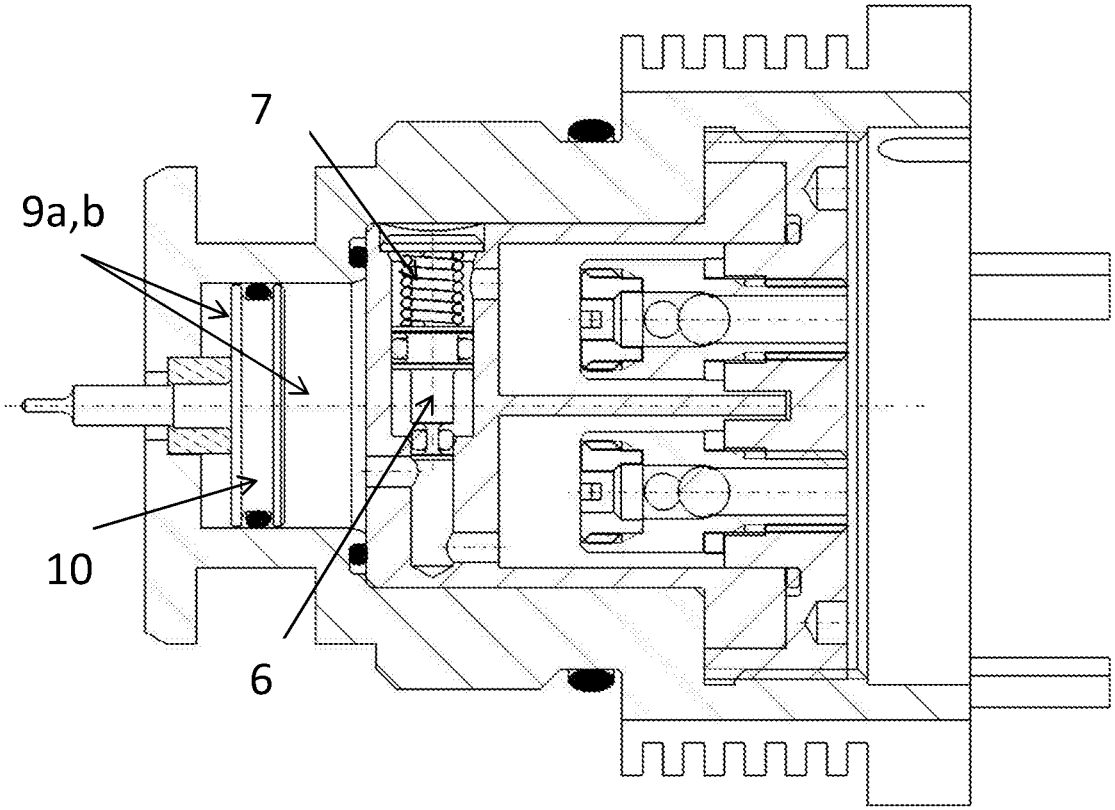
FIG. 4 discloses a delay unit in which piston 6 has reached its end position.

Various parameters may be varied to provide a pressure difference over the piston 6 and thus control the delay unit 11. Provision of an evacuation channel (not shown) positioned on the same side as the inlet channel 1*a* is one option to reduce the accumulated pressure in pressure chamber 3*a* and eventually the pressure in compartments 5*a* and 5*b* to allow for displacement of piston 6 (upwards in FIGS. 2-4). The evacuation channel may be designed with a diameter and length resulting in a suitable pressure difference in compartments 5*a* and 5*b*. The higher the pressure difference over the piston 6, the faster the displacement of the piston 6, and, the faster the combustion gases will flow into subchamber 9 as a consequence of the displacement of piston 6 unblocking opening 8. As the opening 8 is unblocked, the combustion gases will flow into subchamber 9 and actuate subchamber piston 10 which is pressed to the left in the figures (cf. FIGS. 3 and 4). According to a preferred embodiment, subchamber piston 10 is maintained in an initial idle position prior to actuation thereof, e.g. by means of a resilient means such as a spring. As combustion gases enter the subchamber, the subchamber piston will be pressed downstream from its initial position to an end position in analogy with the piston 6 of the piston chamber. As the subchamber piston 10 reaches an end position, various mechanisms may be actuated, for example the breaking of a short circuit 13 as illustrated in FIG. 1. Subchamber piston 10 may also control any other delay mechanism needed subsequent to firing of a projectile. The pressure difference over the piston 6 may be precisely monitored to provide for a very precise predetermined delay. This in turn renders the displacement of the subchamber piston 10 very precise too. An intermediate position of pistons 6 and 10 is shown in FIG. 3 and end positions of pistons 6 and 10 are shown in FIG. 4. FIG. 3 thus shows an intermediate position of piston 6 displaced such that opening 8 of the outlet to subchamber 9 has become partially opened whereby combustion gases present in piston compartment 5*b* enters subchamber 9. As combustion gases enter the subchamber 9, the subchamber piston 10 will thus displace as shown in FIG. 3 wherein subchamber piston 10 divides the subchamber 9 into compartments 9*a*, 9*b* as shown in FIG. 3. In FIG. 4, piston 6 and subchamber piston 10 have been further displaced to their respective end positions. Piston 6 has pressed the spring 7 to its end position whereby piston 6 has reached it end position. As the subchamber piston 10 reaches its end position, an actuation mechanism may be initiated such as the pressing of a copper bushing (initially positioned close to the subchamber wall) through the subchamber wall whereby a short circuit is broken resulting in arming of e.g. a fuze.

The invention claimed is:

1. Delay unit for a projectile, the delay unit comprising:

a first and a second pressure chamber (3*a*, 3*b*) each configured to receive combustion gases in a firearm via at least one inlet (1*a*, 1*b*) arranged to each of said first and second pressure chambers (3*a*, 3*b*) following firing of a projectile; and at least one outlet for transferring the combustion gases (4*a*, 4*b*), arranged to each of said first and second pressure chambers (3*a*, 3*b*), to a piston chamber in which a displaceable piston (6) is arranged dividing the piston chamber into a compartment (5*b*) having a volume $V_1$ upstream the piston (6) and a compartment (5*a*) having a volume $V_2$ downstream the piston (6), wherein:

the outlets (4*a*, 4*b*) from the first and second pressure chambers (3*a*, 3*b*) are configured to transfer said combustion gases to said compartments (5*a*, 5*b*) of said piston chamber to provide an overall pressure difference between compartments (5*a*) and (5*b*) pressing the piston (6) at an initial idle position downstream, whereby the volume $V_2$ of compartment (5*a*) is reduced, and whereby the piston (6) being pressed downstream towards an end position actuates a function at a predetermined point in time following firing of the firearm.

2. Delay unit according to claim 1, wherein a resilient means is configured to maintain the piston (6) immovable at an initial idle position prior to establishing a pressure difference between compartments (5*a*, 5*b*).

3. Delay unit according to claim 1, wherein the piston (6) in said initial idle position is configured to block flow of combustion gases from the piston chamber via an opening (8) between the piston chamber and a sub-chamber (9).

4. Delay unit according to claim 3, wherein the sub-chamber (9) is provided with a displaceable sub-chamber piston (10) configured to be displaced from an initial idle position when exposed to flow of combustion gases originating from the piston chamber.

5. Delay unit according to claim 1, wherein said inlets of the first and second pressure chambers (3*a*, 3*b*) each have an area ranging from 0.1 to 50 $mm^2$.

6. Delay unit according to claim 1, wherein at least one outlet is arranged to at least one of said first and/or second pressure chambers (3*a*, 3*b*) for evacuating a predetermined portion of said combustion gases outside of the delay unit.

7. Delay unit according to claim 1, wherein the outlets for transferring combustion gases (4*a*, 4*b*) to the piston chamber are arranged at the opposite side of the pressure chambers relative to the inlets (1*a*, 1*b*).

8. Delay unit according to claim 1, wherein the piston (6) is configured to be displaced from an initial idle position downstream to an end position such that an opening (8) between the piston chamber and a sub-chamber (9) is unblocked.

9. Delay unit according to claim 1, wherein:

a sub-chamber piston (10) is configured to break a short circuit comprising a piezoelectric sensor following actuation of the sub-chamber piston (10), the sub-chamber piston (10) is configured to be actuated by the combustion gases which flows into the sub-chamber as the opening (8) is unblocked, and as the combustion gases enter the sub-chamber, the sub-chamber piston is configured to be pressed downstream from its initial position to an end position in analogy with the piston (6) of the piston chamber.

10. Delay unit according to claim 6, wherein the outlet for evacuating combustion gases has a length ranging from 1 to 50 mm.

11. Delay unit according to claim 1, wherein the outlet of each pressure chamber (4*a*, 4*b*) for transferring combustion gases has an area ranging from 0.5 to 50 $mm^2$.

12. Delay unit according to claim 1, wherein a fuse is connected to the delay unit.

13. Delay unit according to claim 1, wherein a piezoelectric sensor is connected to the delay unit.

14. Delay unit according to claim 9, wherein the sub-chamber piston (10) is configured to break a short circuit comprising a piezoelectric crystal following actuation of the sub-chamber piston (10).

15. Method of delaying a mechanism for a projectile in a firearm comprising the delay unit according to claim 1, the method comprising the steps of:

receiving combustion gases by the first and the second pressure chamber (3*a*, 3*b*) in a firearm via the at least one inlet (1*a*, 1*b*) following firing of a projectile, and transferring the combustion gases, via the at least one outlet (4*a*, 4*b*), to the piston chamber, wherein the transferring of the combustion gases to the piston chamber provides the overall pressure difference between the compartments (5*a*) and (5*b*) pressing the piston (6) at the initial idle position downstream whereby the volume $V_2$ of the compartment (5*a*) is reduced and whereby the piston (6) being pressed downstream towards the end position actuates the function at the predetermined point in time following the firing of the firearm.

16. Use of a delay unit according to claim 1 for delaying premature detonation of a warhead.

* * * * *